US009147535B2

(12) United States Patent
Lin

(10) Patent No.: US 9,147,535 B2
(45) Date of Patent: Sep. 29, 2015

(54) KEYSWITCH AND KEYBOARD THEREOF

(71) Applicants: DARFON ELECTRONICS (SUZHOU) CO., LTD., Suzhou, Jiangsu Province (CN); DARFON ELECTRONICS CORP., Taoyuan (TW)

(72) Inventor: Shin-Chan Lin, Taoyuan (TW)

(73) Assignees: DARFON ELECTRONICS (SUZHOU) CO., LTD., New District, Suzhou, Jiangsu Province; DARFON ELECTRONICS CORP., Gueishan, Taoyuan (TW)

( * ) Notice: Subject to any disclaimer, the term of this patent is extended or adjusted under 35 U.S.C. 154(b) by 49 days.

(21) Appl. No.: 14/250,386

(22) Filed: Apr. 11, 2014

(65) Prior Publication Data

US 2014/0305781 A1 Oct. 16, 2014

(30) Foreign Application Priority Data

Apr. 11, 2013 (TW) ..... 102112929 A

(51) Int. Cl.
*H01H 13/14* (2006.01)
*H01H 13/7065* (2006.01)
*H01H 3/12* (2006.01)

(52) U.S. Cl.
CPC ..... *H01H 13/7065* (2013.01); *H01H 3/125* (2013.01); *H01H 2229/042* (2013.01)

(58) Field of Classification Search
USPC ..... 400/490–496; 200/5 A, 344–345, 517, 200/314, 317, 512
See application file for complete search history.

(56) References Cited

U.S. PATENT DOCUMENTS

| | | | | |
|---|---|---|---|---|
| 6,257,782 | B1 * | 7/2001 | Maruyama et al. | 400/495.1 |
| 6,538,641 | B2 * | 3/2003 | Mochizuki | 345/168 |
| 6,812,421 | B2 * | 11/2004 | Sato et al. | 200/344 |
| 8,759,705 | B2 * | 6/2014 | Funakoshi et al. | 200/532 |

FOREIGN PATENT DOCUMENTS

| | | |
|---|---|---|
| CN | 201425901 Y | 3/2010 |
| TW | 200834292 | 8/2008 |
| TW | 200901255 | 1/2009 |
| TW | M405002 | 6/2011 |

* cited by examiner

*Primary Examiner* — Edwin A. Leon
(74) *Attorney, Agent, or Firm* — Winston Hsu; Scott Margo

(57) ABSTRACT

A keyswitch includes a base, a keytop, and first and second support members rotatably intersecting with each other. The keytop has an engaging slot having a rotation space and an opening. The first support member has a first pivot shaft pivoted to the engaging slot and a first connecting mechanism movably connected to the base. When the first pivot shaft is passing through the opening, the engaging slot squeezes the first pivot shaft to cause deformation of a groove of the first pivot shaft so as to make the first pivot shaft have a first size. When the first pivot shaft enters the rotation space, the amount of deformation of the groove decreases to make the first pivot shaft have a second size greater than the first size and a gap of the opening, so that the first pivot shaft could be constrained in the engaging slot.

12 Claims, 7 Drawing Sheets

KEYSWITCH AND KEYBOARD THEREOF

BACKGROUND OF THE INVENTION

1. Field of the Invention

The present invention relates to a keyswitch and a keyboard thereof, and more specifically, to a keyswitch with a pivot shaft of a support member having a groove formed thereon and a keyboard thereof.

2. Description of the Prior Art

A keyboard, which is the most common input device, could be found in variety of electronic apparatuses for users to input characters, symbols, numerals and so on. Furthermore, from consumer electronic products to industrial machine tools, they are all equipped with a keyboard for performing input operations.

Please refer to FIG. 1, which is a sectional diagram of a keyswitch 1 according to the prior art. As shown in FIG. 1, the keyswitch 1 includes a base 10, a keytop 12, a circuit board 14, a support device 16, and an elastic member 18. The circuit board 14 is disposed on the base 10. The support device 16 and the elastic member 18 are disposed between the base 10 and the keytop 12. Furthermore, the keytop 12 has a first sliding slot 11 and a first engaging slot 13, and the base 10 has a second sliding slot 15 and a second engaging slot 17. The support device 16 includes a first support member 19 and a second support member 21. The first support member 19 rotatably intersects with the second support member 21. The first support member 19 has a first sliding shaft 23 and a first pivot shaft 25. The first sliding shaft 23 is slidably disposed in the second sliding slot 15, and the first pivot shaft 25 is rotatably pivoted to the first engaging slot 13. The second support member 21 has a second sliding shaft 27 and a second pivot shaft 29. The second sliding shaft 27 is slidably disposed in the first sliding slot 11, and the second pivot shaft 29 is rotatably pivoted to the second engaging slot 17. In such a manner, the keytop 12 could be movable upward and downward relative to the base 10 via connection of the support device 16 with the keytop 12 and the base 10 and elastic force provided by the elastic member 18.

As shown in FIG. 1, the keyswitch 1 adopts the assembly design in which the first pivot shaft 25 of the first support member 19 passes through the an opening 31 of the first engaging slot 13 to be pivoted to the first engaging slot 13 of the keytop 12. For making the first pivot shaft 25 pivoted to the first engaging slot 13 more steadily, a gap of the opening 31 could be reduced to increase the assembly strength between the keytop 12 and the support device 16, so as to prevent the keytop 12 from falling out of the support device 16 accidentally. However, the aforesaid design not only makes assembly of the first pivot shaft 25 and the first engaging slot 13 more difficult during the keytop 12 is assembled with the support device 16, but also causes damage of the first engaging slot 13 easily during the aforesaid assembly process.

Although the aforesaid problem could be solved by increasing the gap of the opening 31, it decreases the assembly strength between the keytop 12 and the support device 16 accordingly, so as to make the keytop 12 fall out of the support device 16 easily.

SUMMARY OF THE INVENTION

An objective of the present invention is to provide a keyswitch with a pivot shaft of a support member having a groove formed thereon and a keyboard thereof for solving the aforesaid problem.

According to an embodiment of the present invention, a keyswitch includes a base, a keytop, a first support member, and a second support member. The keytop has an engaging slot. The engaging slot has a rotation space and an opening. The opening has a gap. The first support member has a first pivot shaft and a first connecting mechanism. The first pivot shaft is pivoted to the engaging slot. The first connecting mechanism is movably connected to the base. The first pivot shaft has a groove. The second support member rotatably intersects with the first support member and has a second connecting mechanism and a third connecting mechanism. The second connecting mechanism is movably connected to the keytop. The third connecting mechanism is movably connected to the base. The keytop is movable upward and downward relative to the base with movement of the first support member relative to the second support member. When the first pivot shaft is passing through the opening of the engaging slot during the first pivot shaft is assembled into the engaging slot, the first pivot shaft is squeezed by the engaging slot to cause deformation of the groove of the first pivot shaft so as to make the first pivot shaft have a first size. When the first pivot shaft enters the rotation space via the opening, the amount of deformation of the slot decreases to make the first pivot shaft have a second size greater than the first size and the gap of the opening, so as to make the first pivot shaft constrained in the engaging slot.

According to another embodiment of the present invention, a keyboard includes a base and a plurality of keyswitches. The plurality of keyswitches is disposed on the base. At least one of the keyswitches includes a base, a keytop, a first support member, and a second support member. The keytop has an engaging slot. The engaging slot has a rotation space and an opening. The opening has a gap. The first support member has a first pivot shaft and a first connecting mechanism. The first pivot shaft is pivoted to the engaging slot. The first connecting mechanism is movably connected to the base. The first pivot shaft has a groove. The second support member rotatably intersects with the first support member and has a second connecting mechanism and a third connecting mechanism. The second connecting mechanism is movably connected to the keytop. The third connecting mechanism is movably connected to the base. The keytop is movable upward and downward relative to the base with movement of the first support member relative to the second support member. When the first pivot shaft is passing through the opening of the engaging slot during the first pivot shaft is assembled into the engaging slot, the first pivot shaft is squeezed by the engaging slot to cause deformation of the groove of the first pivot shaft so as to make the first pivot shaft have a first size. When the first pivot shaft enters the rotation space via the opening, the amount of deformation of the slot decreases to make the first pivot shaft have a second size greater than the first size and the gap of the opening, so as to make the first pivot shaft constrained in the engaging slot.

In summary, the present invention adopts the design in which the pivot shaft of the support member has the groove formed thereon, to generate the effect that the groove is squeezed by the engaging slot to bend inwardly during the pivot shaft is assembled into the engaging slot of the keytop. Accordingly, the pivot shaft could be assembled into the engaging slot smoothly so as to effectively prevent jamming between the pivot shaft and the engaging slot. In such a manner, the present invention could make assembly of the keytop and the support member much easier and solve the prior art problem that the support member is damaged easily during the assembly process. Furthermore, via the aforesaid design, the present invention could increase the assembly strength between the pivot shaft and the engaging slot since the groove of the pivot shaft is no longer squeezed by the engaging slot to make the pivot shaft have the larger size after the pivot shaft is assembled into the engaging slot. Thus, the pivot shaft could be constrained in the engaging slot steadily, so as to solve the prior art problem that the keytop could fall out of the support device easily.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
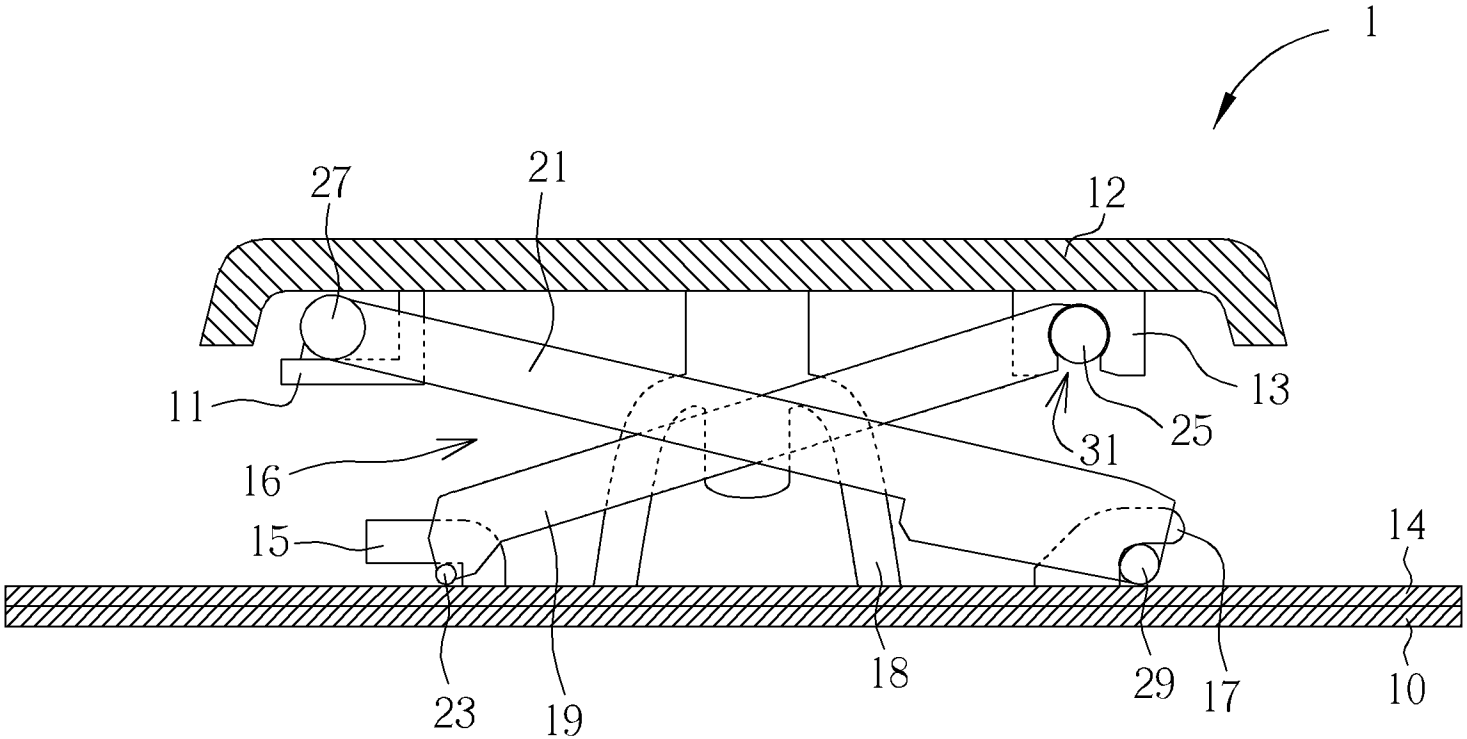
FIG. 1 PRIOR ART
FIG. 1 is a sectional diagram of a keyswitch according to the prior art.
Figure 2:
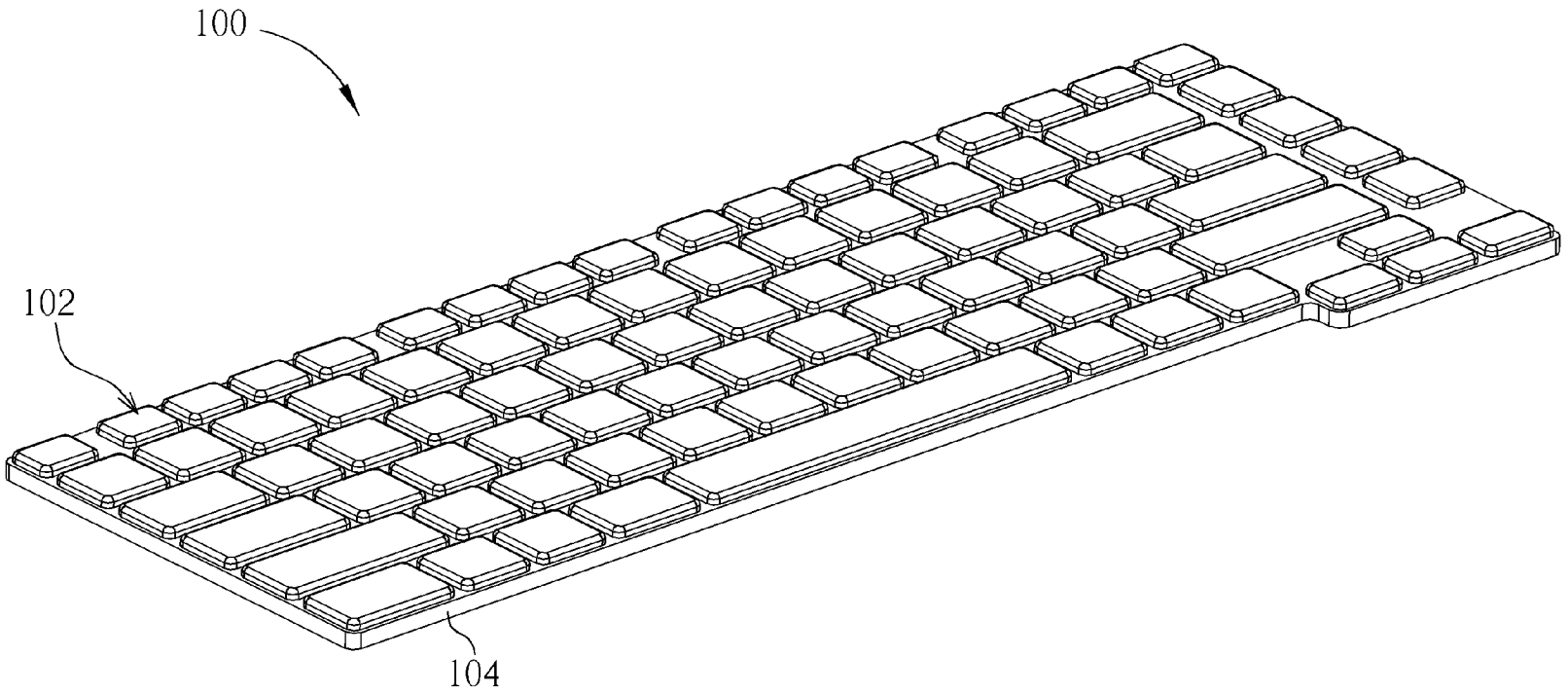
FIG. 2 is a diagram of a keyboard according to an embodiment of the present invention.

Please refer to FIG. 2, which is a diagram of a keyboard 100 according to an embodiment of the present invention. As shown in FIG. 2, the keyboard 100 includes a plurality of keyswitches 102 and a base 104. The plurality of keyswitches 102 is disposed on the base 104 for a user to perform input operations. The keytop design of the present invention could be applied to at least one of the plurality of keyswitches 102. In the following, more detailed description for only one keyswitch 102 to which the aforesaid keytop design is applied is provided. As for the related description for other keyswitches 102 utilizing the same keytop design, it could be reasoned by analogy.

Figure 3:
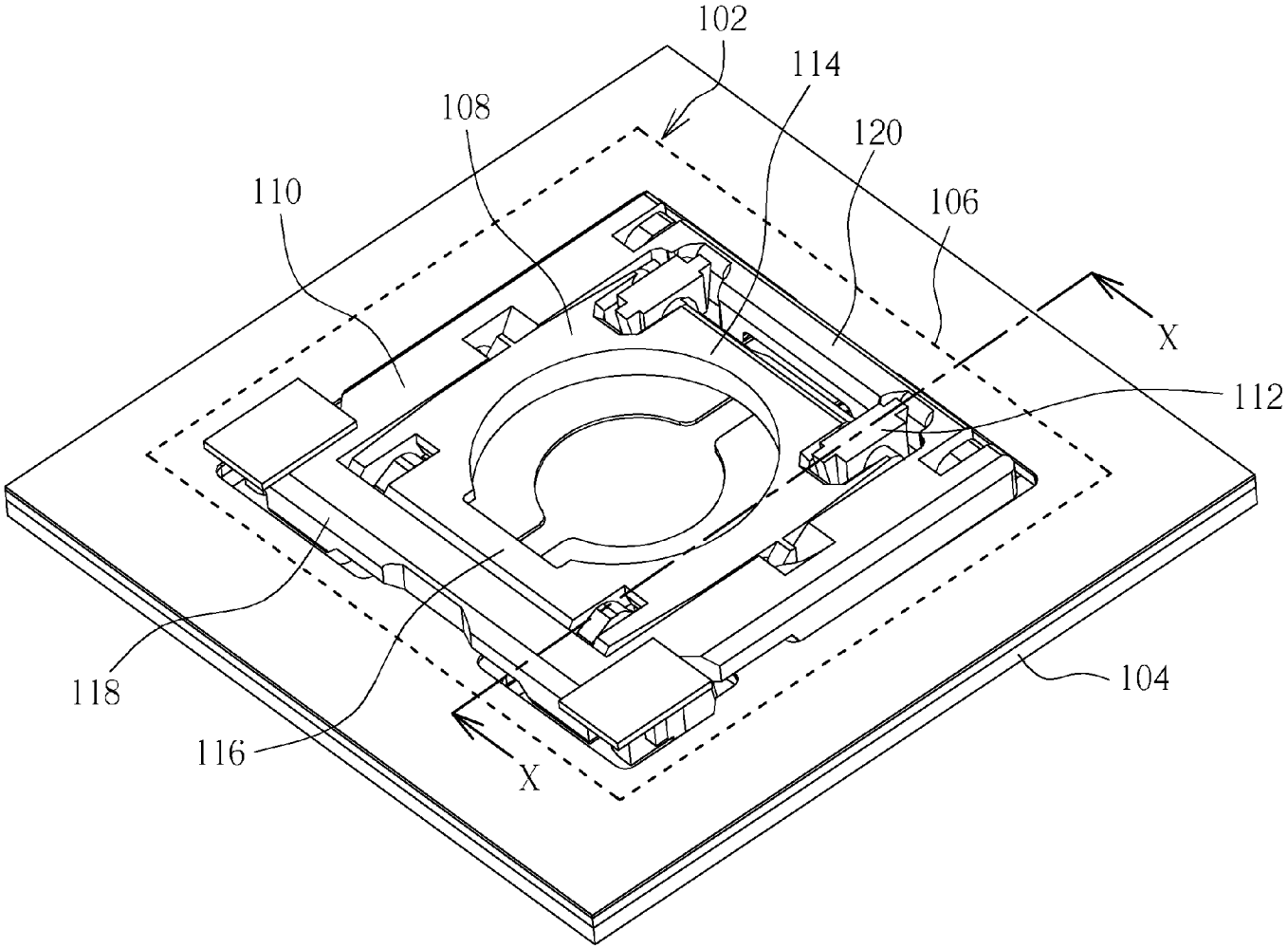
FIG. 3 is an enlarged diagram of a keyswitch in FIG. 2.
Figure 4:
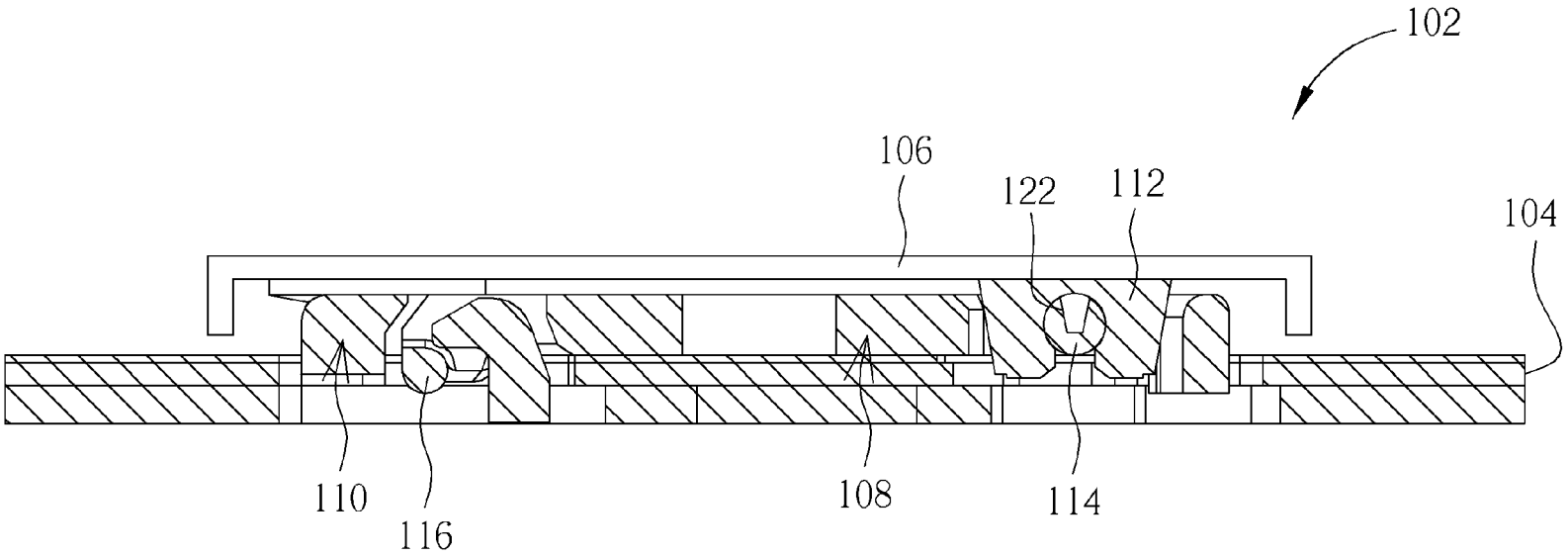
FIG. 4 is a sectional diagram of the keyswitch in FIG. 3 along a sectional line X-X.

Please refer to FIG. 3 and FIG. 4. FIG. 3 is an enlarged diagram of the keyswitch 102 in FIG. 2. FIG. 4 is a sectional diagram of the keyswitch 102 in FIG. 3 along a sectional line X-X. For clearly showing the inner mechanism of the keyswitch 102, a keytop 106 is briefly depicted in FIG. 3. As shown in FIG. 3 and FIG. 4, the keyswitch 102 includes the keytop 106, a first support member 108, and a second support member 110. The keytop 106 has an engaging slot 112. The first support member 108 has a first pivot shaft 114 and a first connecting mechanism 116. The first pivot shaft 114 is pivoted to the engaging slot 112. The first connecting mechanism 116 is movably connected to the base 104. The second support member 110 rotatably intersects with the first support member 108. The second support member 110 has a second connecting mechanism 118 and a third connecting mechanism 120. The second connecting mechanism 118 is movably connected to the keytop 106. The third mechanism 120 is movably connected to the base 104. With rotation of the first support member 108 and the second support member 110, the keytop 106 could move upward and downward relative to the base 104. The scissor support design commonly adopted by a conventional keyboard could be applied to connection of the first connecting mechanism 116 with the third connecting mechanism 120 and the base 104 and connection of the second connecting mechanism 118 with the keytop 106. For example, the first connecting mechanism 116 could be a sliding shaft and be slidably disposed in a corresponding sliding slot of the base 104. As for the related description for the aforesaid scissor support design, it is commonly seen in the prior art and omitted herein.

Figure 5:
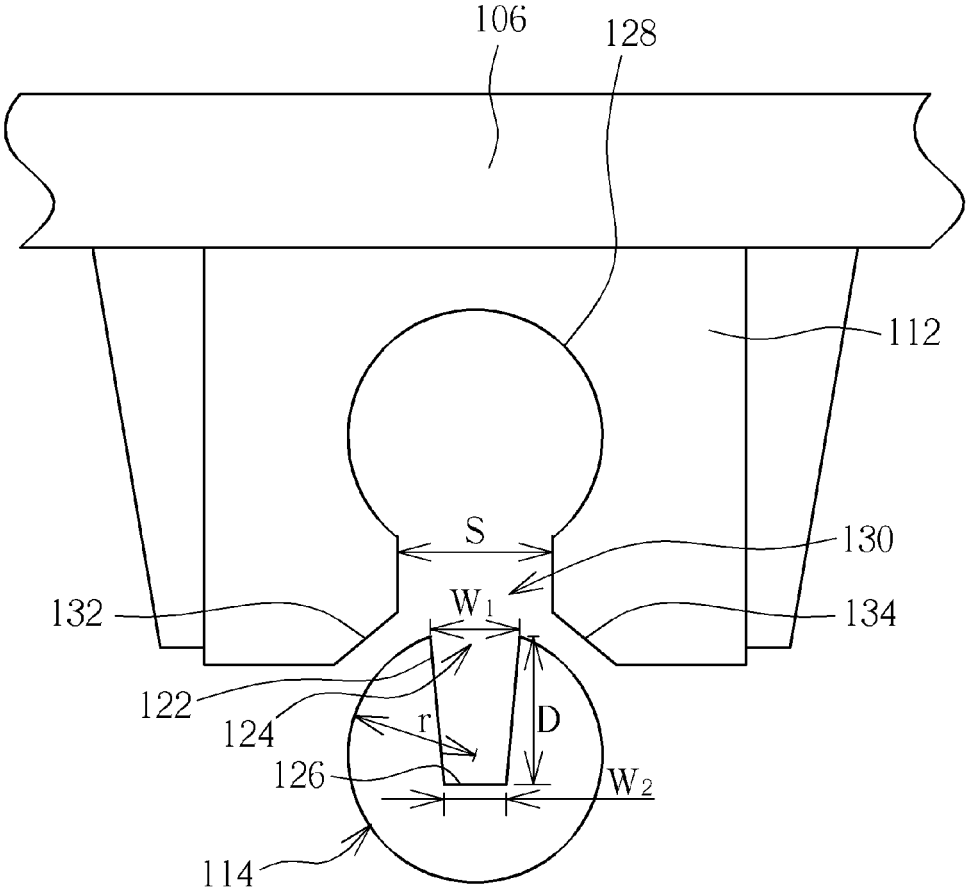
FIG. 5 is a partial enlarged diagram showing that an engaging slot in FIG. 4 has not been assembled with a first pivot shaft.

More detailed description for connection of the engaging slot 112 of the keytop 106 with the first pivot shaft 114 of the first support member 108 is provided as follows. Please refer to FIG. 4 and FIG. 5. FIG. 5 is a partial enlarged diagram showing that the engaging slot 112 in FIG. 4 has not been assembled with the first pivot shaft 114. As shown in FIG. 4 and FIG. 5, the first pivot shaft 114 has a groove 122. The groove 122 preferably faces the engaging slot 112 of the keytop 106. A depth D of the groove 122 is preferably greater than a radius r of the first pivot shaft 114, so as to make the first pivot shaft 114 have a U shape. A width $W_1$ of an opening 124 of the groove 122 is greater than a width $W_2$ of a bottom surface 126 of the groove 122, so as to make the groove 122 have a radiation shape. In practical application, the width $W_1$ of the opening 124 is substantially equal to 0.3 mm and the width $W_2$ of the bottom surface 126 is substantially equal to 0.2 mm (but not limited thereto). In other words, the size of the groove 122 is not limited to this embodiment but varies with the practical assembly needs of the keyboard 100. Furthermore, the shape design of the groove 122 could also be not limited to this embodiment. That is, all designs for forming a groove on a pivot shaft of a support member of a keyswitch to make the pivot shaft smoothly assembled into and difficultly detached from an engaging slot of a keytop of a keyswitch fall within the scope of the present invention.

As shown in FIG. 5, the engaging slot 112 has a rotation space 128 and an opening 130. In this embodiment, the opening 130 has a gap S, and the engaging slot 112 has a left lead angle 132 and a right lead angle 134. Accordingly, during the first pivot shaft 114 is assembled into the engaging slot 112, the left lead angle 132 and the right lead angle 134 could be aligned with the left side and a right side of the groove 122 respectively to squeeze the groove 122 for making the groove 122 bend inwardly.

Figure 6:
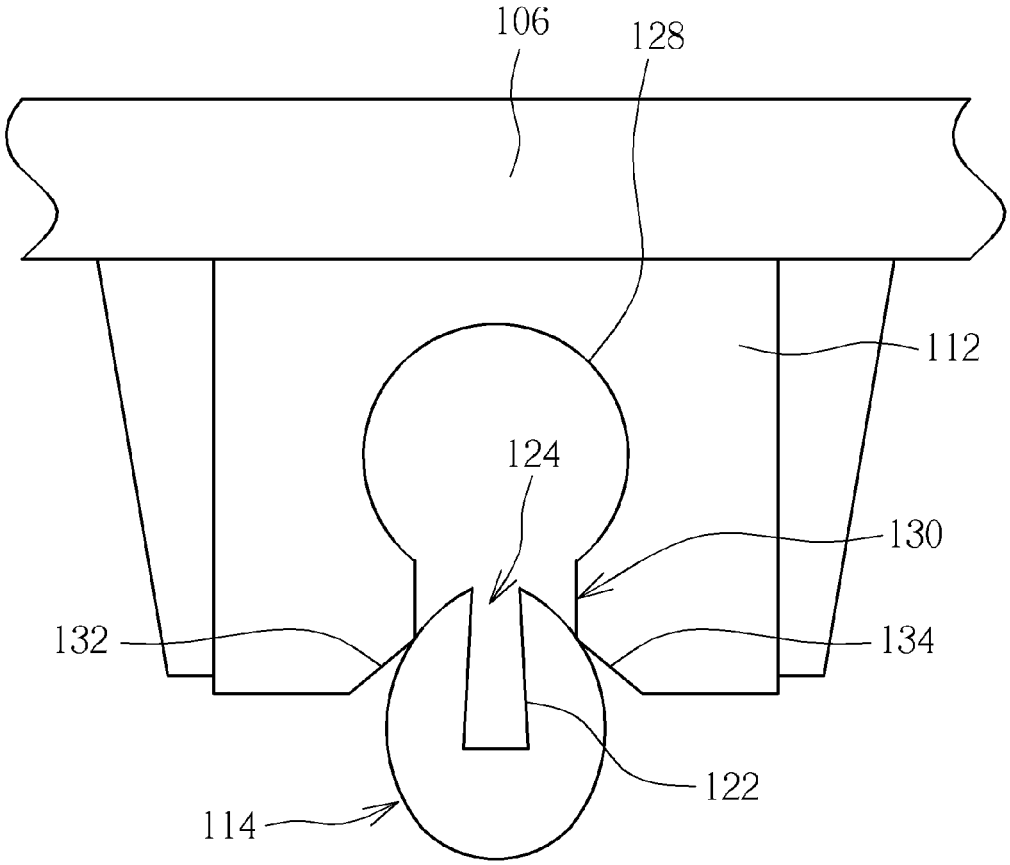
FIG. 6 is a partial enlarged diagram of the first pivot shaft in FIG. 5 passing through an opening of the engaging slot.
Figure 7:
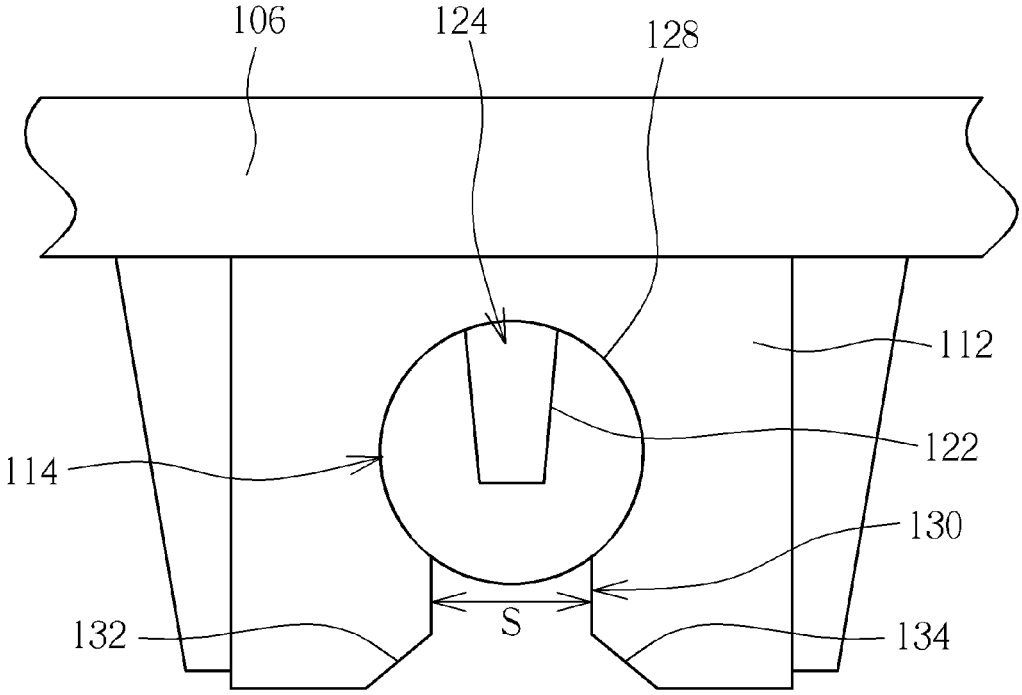
FIG. 7 is a partial enlarged diagram of the first pivot shaft in FIG. 6 entering the engaging slot.

Via the aforesaid design, during the first pivot shaft 114 is assembled into the engaging slot 112, the first pivot shaft 114 is squeezed by the left lead angle 132 and the right lead angle 134 of the engaging slot 112 to make the groove 122 bend inwardly (as shown in FIG. 6) when the first pivot shaft 114 is passing through the opening 130, so that the first pivot shaft 114 could have a first size which is relatively smaller. Accordingly, the first pivot shaft 114 could pass through the opening 130 smoothly so as to prevent jamming between the first pivot shaft 114 and the engaging slot 112. Subsequently, when the first pivot shaft 114 enters the rotation space 128 of the engaging slot 112 via the opening 130, the amount of deformation of the groove 122 decreases since the groove 122 of the first pivot shaft 114 is no longer squeezed by the engaging slot 112, so that the first pivot shaft 114 could have a second size which is relatively larger as shown in FIG. 7. At this time, since the second size of the first pivot shaft 114 as shown in FIG. 7 is greater than the first size of the first pivot shaft 114 as shown in FIG. 6 and the gap S of the opening 130, the first pivot shaft 114 could be steadily constrained in the engaging slot 112, so as to complete assembly of the first pivot shaft 114 of the first support member 108 and the engaging slot 112 of the keytop 106.

In such a manner, in this embodiment, with upward and downward movement of the keytop 106 relative to the base 104, the opening 124 of the groove 122 could rotate in the rotation space 128 correspondingly and keeps facing the engaging slot 112 without rotating to face the opening 130. Accordingly, the keyboard 100 could effectively prevent the first pivot shaft 114 from falling out of the engaging slot 112 accidentally while the keytop 106 moves upward and downward relative to the base 104.

Compared with the prior art, the present invention adopts the design in which the pivot shaft of the support member has the groove formed thereon, to generate the effect that the groove is squeezed by the engaging slot to bend inwardly during the pivot shaft is assembled into the engaging slot of the keytop. Accordingly, the pivot shaft could be assembled into the engaging slot smoothly so as to effectively prevent jamming between the pivot shaft and the engaging slot. In such a manner, the present invention could make assembly of the keytop and the support member much easier and solve the prior art problem that the support member is damaged easily during the assembly process. Furthermore, via the aforesaid design, the present invention could increase the assembly strength between the pivot shaft and the engaging slot since the groove of the pivot shaft is no longer squeezed by the engaging slot to make the pivot shaft have the larger size after the pivot shaft is assembled into the engaging slot. Thus, the pivot shaft could be constrained in the engaging slot steadily, so as to solve the prior art problem that the keytop could fall out of the support device easily.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyswitch comprising:

a base;

a keytop having an engaging slot, the engaging slot having a rotation space and an opening, the opening having a gap;

a first support member having a first pivot shaft and a first connecting mechanism, the first pivot shaft being pivoted to the engaging slot, the first connecting mechanism being movably connected to the base, the first pivot shaft having a groove; and a second support member rotatably intersecting with the first support member and having a second connecting mechanism and a third connecting mechanism, the second connecting mechanism being movably connected to the keytop, the third connecting mechanism being movably connected to the base, the keytop being movable upward and downward relative to the base with movement of the first support member relative to the second support member;

wherein when the first pivot shaft is passing through the opening of the engaging slot during the first pivot shaft is assembled into the engaging slot, the first pivot shaft is squeezed by the engaging slot to cause deformation of the groove of the first pivot shaft so as to make the first pivot shaft have a first size; when the first pivot shaft enters the rotation space via the opening, the amount of deformation of the slot decreases to make the first pivot shaft have a second size greater than the first size and the gap of the opening, so as to make the first pivot shaft constrained in the engaging slot.

2. The keyswitch of claim 1, wherein a depth of the groove is greater than a radius of the first pivot shaft to make the first pivot shaft have a U shape.

3. The keyswitch of claim 1, wherein the engaging slot has a left lead angle and a right lead angle, and during the first pivot shaft is assembled into the engaging slot, the left lead angle and the right lead angle are aligned with a left side and a right side of the groove respectively for squeezing the groove, so as to cause inward bending deformation of the groove.

4. The keyswitch of claim 1, wherein a width of an opening of the groove is greater than a width of a bottom surface of the groove to make the groove have a radiation shape.

5. The keyswitch of claim 4, wherein the width of the opening of the groove is substantially equal to 0.3 mm, and the width of the bottom surface is substantially equal to 0.2 mm.

6. The keyswitch of claim 1, wherein the groove has an opening, and the opening of the groove rotates in the rotation space with upward and downward movement of the keytop relative to the base and keeps facing the engaging slot without rotating to face the opening of the engaging slot.

7. A keyboard comprising:

a base; and a plurality of keyswitches disposed on the base, at least one of the keyswitches comprising:

a keytop having an engaging slot, the engaging slot having a rotation space and an opening, the opening having a gap;

a first support member having a first pivot shaft and a first connecting mechanism, the first pivot shaft being pivoted to the engaging slot, the first connecting mechanism being movably connected to the base, the first pivot shaft having a groove; and a second support member rotatably intersecting with the first support member and having a second connecting mechanism and a third connecting mechanism, the second connecting mechanism being movably connected to the keytop, the third connecting mechanism being movably connected to the base, the keytop being movable upward and downward relative to the base with movement of the first support member relative to the second support member;

wherein when the first pivot shaft is passing through the opening of the engaging slot during the first pivot shaft is assembled into the engaging slot, the first pivot shaft is squeezed by the engaging slot to cause deformation of the groove of the first pivot shaft so as to make the first pivot shaft have a first size; when the first pivot shaft enters the rotation space via the opening, the amount of deformation of the slot decreases to make the first pivot shaft have a second size greater than the first size and the gap of the opening, so as to make the first pivot shaft constrained in the engaging slot.

8. The keyboard of claim 7, wherein a depth of the groove is greater than a radius of the first pivot shaft to make the first pivot shaft have a U shape.

9. The keyboard of claim 7, wherein the engaging slot has a left lead angle and a right lead angle, and during the first pivot shaft is assembled into the engaging slot, the left lead angle and the right lead angle are aligned with a left side and a right side of the groove respectively for squeezing the groove, so as to cause inward bending deformation of the groove.

10. The keyboard of claim 7, wherein a width of an opening of the groove is greater than a width of a bottom surface of the groove to make the groove have a radiation shape.

11. The keyboard of claim 10, wherein the width of the opening of the groove is substantially equal to 0.3 mm, and the width of the bottom surface is substantially equal to 0.2 mm.

12. The keyboard of claim 7, wherein the groove has an opening, and the opening of the groove rotates in the rotation space with upward and downward movement of the keytop relative to the base and keeps facing the engaging slot without rotating to face the opening of the engaging slot.

* * * * *